US006918062B2

(12) United States Patent
Wang et al.

(10) Patent No.: US 6,918,062 B2
(45) Date of Patent: Jul. 12, 2005

(54) SYSTEM AND METHOD TO IMPLEMENT A COST-EFFECTIVE REMOTE SYSTEM MANAGEMENT MECHANISM USING A SERIAL COMMUNICATION CONTROLLER AND INTERRUPTS

(75) Inventors: Jennifer C. Wang, Tempe, AZ (US); Aniruddha P. Joshi, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 550 days.

(21) Appl. No.: 09/968,351

(22) Filed: Sep. 28, 2001

(65) Prior Publication Data

US 2003/0065852 A1 Apr. 3, 2003
US 2004/0225788 A9 Apr. 3, 2003

(51) Int. Cl.[7] ..... G06F 11/00
(52) U.S. Cl. ..... 714/43; 714/4; 714/11
(58) Field of Search ..... 714/4, 43, 11, 714/34

(56) References Cited

U.S. PATENT DOCUMENTS 4,775,976 A * 10/1988 Yokoyama ..... 714/4
5,367,695 A 11/1994 Narad et al.
5,392,407 A 2/1995 Heil et al.
5,499,346 A 3/1996 Amini et al.
5,524,235 A 6/1996 Larson et al.
5,537,654 A 7/1996 Bedingfield et al.
5,548,730 A 8/1996 Young et al.
5,555,430 A 9/1996 Gephardt et al.
5,579,522 A 11/1996 Christeson et al.
5,761,458 A 6/1998 Young et al.
5,790,849 A 8/1998 Crocker et al.
5,845,136 A 12/1998 Babcock
5,854,905 A 12/1998 Garney
5,892,895 A * 4/1999 Basavaiah et al. ..... 714/4
6,047,373 A 4/2000 Hall et al.
6,256,731 B1 7/2001 Hall et al.
6,665,811 B1 * 12/2003 de Azevedo et al. ..... 714/4
2002/0152414 A1 * 10/2002 Barron et al. ..... 714/4
2003/0046339 A1 * 3/2003 Ip ..... 709/203

OTHER PUBLICATIONS

Low Pin Count (LPC) Interface Specificaiton, Revision 1.0, Copyright Intel Corporation, Sep. 29, 1997.

* cited by examiner

*Primary Examiner*—Dieu-Minh Le
*Assistant Examiner*—Yolanda L Wilson
(74) *Attorney, Agent, or Firm*—Blakely, Sokoloff, Taylor & Zafman LLP

(57) ABSTRACT

The present invention relates to a system and method to implement a cost-effective remote system management mechanism using a serial communication controller and interrupts. The system includes a requesting device operatively coupled to a network to send a status query through a serial port in the requesting device. The system further includes a responding device operatively coupled to the network to receive the status query from the requesting device. The status query inquires about operational status of the responding device. The responding device receives the status query through a serial port in the responding device, processes the status query, and reports the operational status through the serial port in the responding device to the requesting device in response to the status query sent by the requesting device.

9 Claims, 5 Drawing Sheets

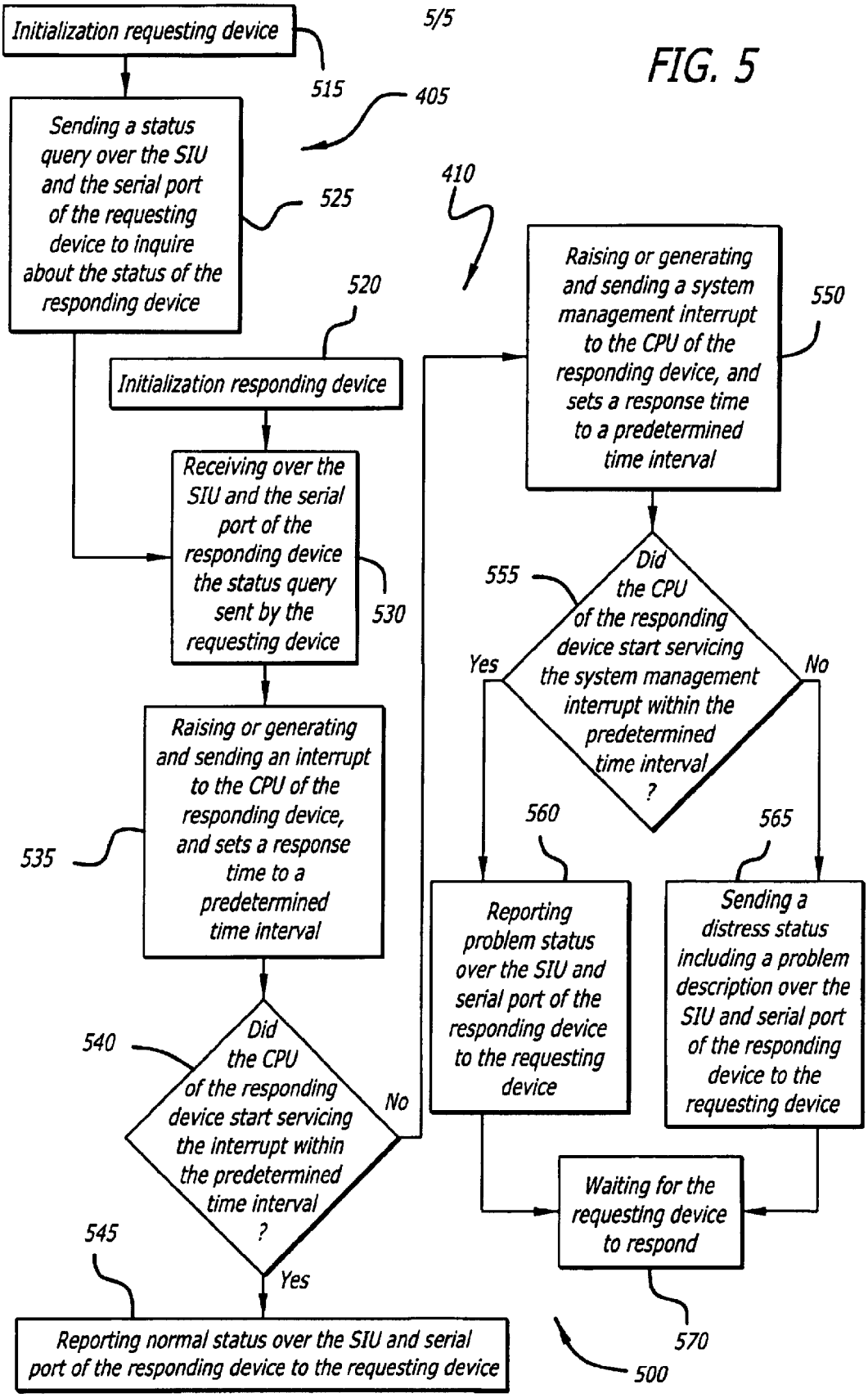
5/5
FIG. 5
Initialization requesting device
515
405
Sending a status query over the SIU and the serial port of the requesting device to inquire about the status of the responding device
525
410
520
Initialization responding device
Receiving over the SIU and the serial port of the responding device the status query sent by the requesting device
530
Raising or generating and sending an interrupt to the CPU of the responding device, and sets a response time to a predetermined time interval
535
Did the CPU of the responding device start servicing the interrupt within the predetermined time interval ?
540
No
Yes
545
Reporting normal status over the SIU and serial port of the responding device to the requesting device
Raising or generating and sending a system management interrupt to the CPU of the responding device, and sets a response time to a predetermined time interval
550
Did the CPU of the responding device start servicing the system management interrupt within the predetermined time interval ?
555
Yes
No
560
565
Reporting problem status over the SIU and serial port of the responding device to the requesting device
Sending a distress status including a problem description over the SIU and serial port of the responding device to the requesting device
Waiting for the requesting device to respond
570
500

SYSTEM AND METHOD TO IMPLEMENT A COST-EFFECTIVE REMOTE SYSTEM MANAGEMENT MECHANISM USING A SERIAL COMMUNICATION CONTROLLER AND INTERRUPTS

BACKGROUND (1) Field

The present invention relates to a system and method to implement a cost-effective remote system management mechanism using a serial communication controller and interrupts.

(2) General Background

Network computing devices are widely used in consumer and commercial environments. Network computing devices typically include a network interface application that communicates with other devices over a network. As network computing devices and their application programs become more sophisticated, it is becoming increasingly clear that their total cost of ownership, including hardware and software maintenance and upgrades, may be much larger than the initial cost of the hardware and software itself. One way to keep the total cost of ownership of networking computing devices is to provide a mechanism to remotely manage these devices.

BRIEF DESCRIPTION OF THE DRAWINGS

FIG. 5 generally outlines an exemplary sequence of events and correspondences between the requesting device and the responding device occurring when the requesting device sends or submits a status query to the responding device in accordance with one embodiment of the present invention.

DETAILED DESCRIPTION

The present invention relates to a system and method to implement a cost-effective remote system management mechanism using a serial communication controller and interrupts.

Figure 1:
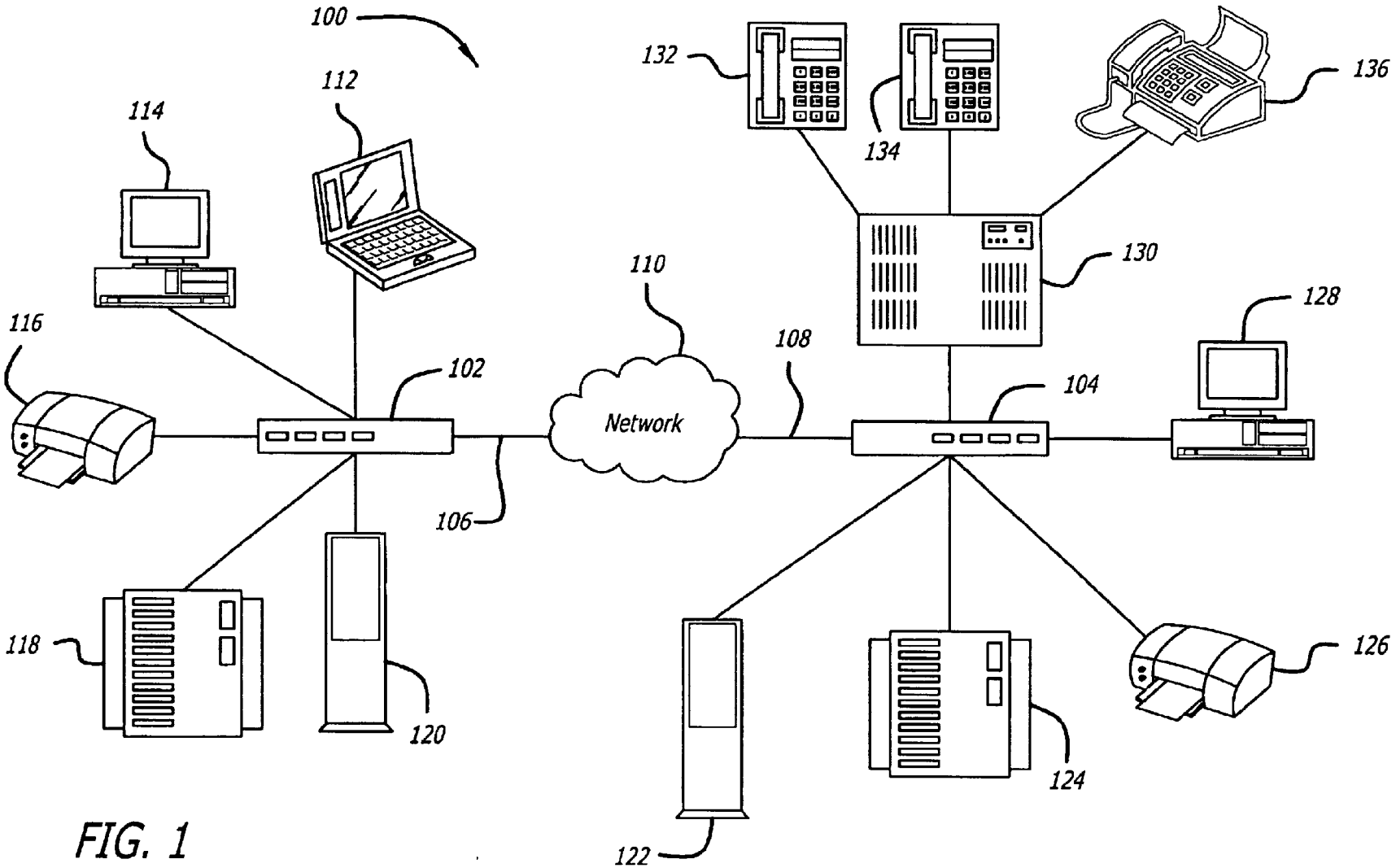
FIG. 1 is an exemplary diagram of a system in accordance with one embodiment of the present invention.

FIG. 1 is an exemplary diagram of a networking system 100 in accordance with one embodiment of the present invention. The networking system 100 includes network switches or routers 102, 104 that are operatively coupled together by network links 106,108 and network 110.

Network switch or router 102 is coupled to a plurality of network devices 112, 114, 116, 118, 120. Network devices are generally computing devices having networking capability. As illustrated in FIG. 1, examples of network devices can include a laptop computer 112, a desktop computer 114, a network printer 116, a network storage device 118, and a server 120. In practice, a network device can be a set-top-box, a hand-held device, a network appliance, or any computing devices with networking capability.

Network switch or router 104 is coupled to a plurality of network devices, including a server 122, a network storage device 124, a network printer 126, and a desktop 128. Network switch or router is also coupled to a private branch exchange (PBX) system 130. PBX system 130 is coupled to telephones 132, 134 and fax machine 136.

Each network device in the networking system 100 can be a requesting device, a responding device, or both. A requesting device is generally a network device that initiates and sends a status query to a responding device to request or inquire about the operational status of the responding device. A responding device is generally a network device that receives the status query from the requesting device and performs the necessary actions to respond or answer to the status query. Additional details on the structure of the requesting device and the responding device will be shown in FIGS. 2, 3, and 4 and described in the text accompanying these figures. Additional information detailing the sequence of events and correspondences between the requesting device and the responding device will be shown in FIG. 5 and described in the text accompanying this figure.

Figure 2:
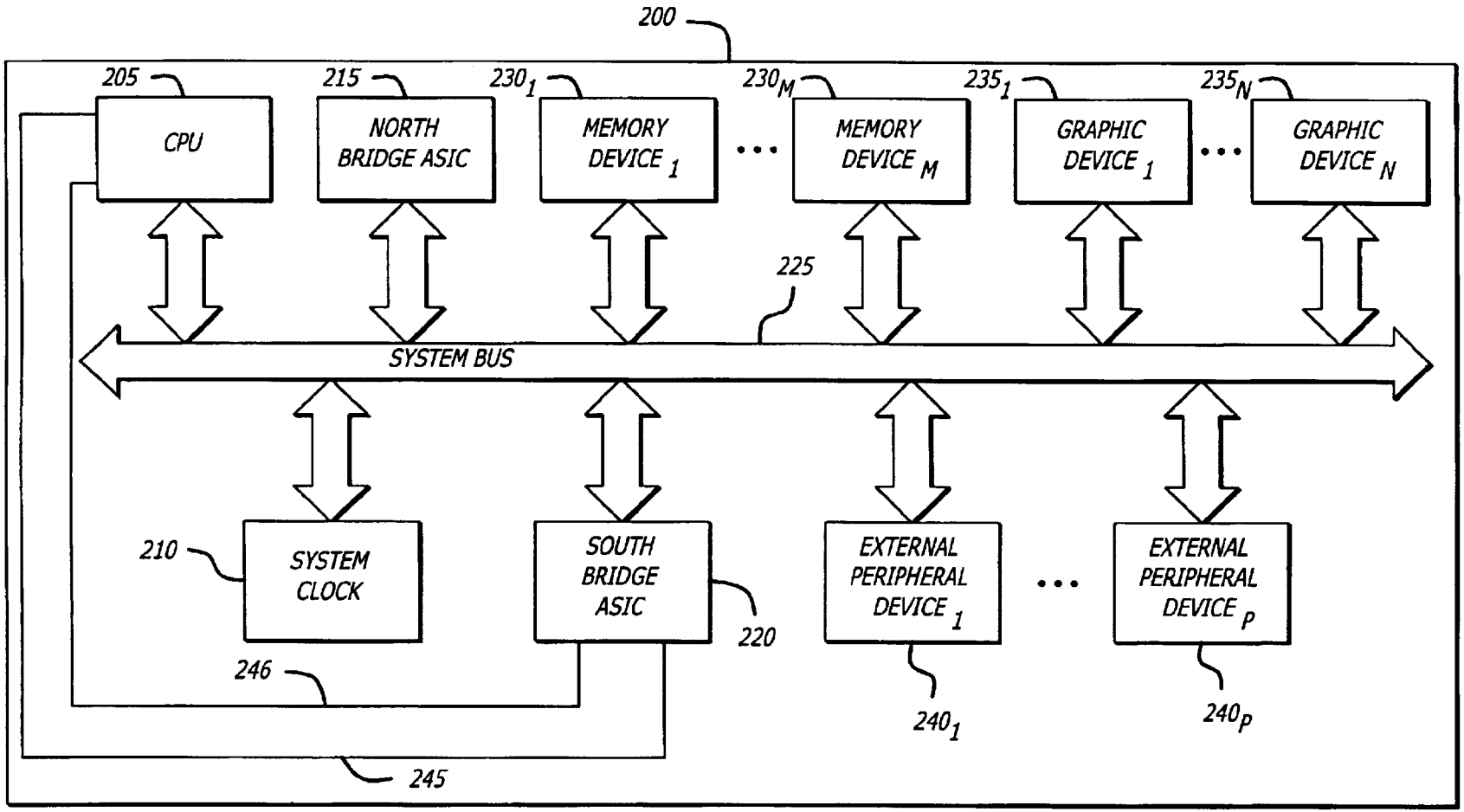
FIG. 2 is an exemplary block diagram showing pertinent functional components of a network device in the networking system of FIG. 1 in accordance with one embodiment of the present invention.

FIG. 2 is an exemplary block diagram showing pertinent functional components of a network device 200 in the networking system 100 of FIG. 1 in accordance with one embodiment of the present invention. As shown in FIG. 1 and described in the text accompanying the figure, a network device 200 (shown in FIG. 2) in the networking system 100 may be a laptop computer 112, a desktop computer 114, a network printer 116, a network storage device 118, a server 120, a network storage device 124, a network printer 126, a desktop 128, a private branch exchange (PBX) system 130. In addition, a network device 200 can be a set-top-box, a hand-held device, a network appliance, or any computing devices with networking capability.

As shown in FIG. 2, network device 200 can include a CPU (Central Processing Unit) 205, a system clock 210, a North Bridge ASIC (Application Specific Integrated Circuit) 215, and a South Bridge ASIC 220. CPU 205, North Bridge ASIC 215, and South Bridge ASIC 220 are operatively coupled to a system address, data, and control bus (or system bus) 225. CPU 205 can communicate with North Bridge ASIC 215 and South Bridge ASIC 220 through the system bus 225. In one embodiment, system bus 225 is a PCI (Peripheral Component Interconnect) bus. System clock 210 generally provides timing pulses at constant time intervals that can be used by other components within the network device. North Bridge ASIC 215 can generally serve as a controller for memory devices $\mathbf{230}_1, \ldots, \mathbf{230}_M$ (where "M" is a positive integer) and graphic devices $\mathbf{235}_1, \ldots, \mathbf{235}_N$ (where "N" is a positive integer). South Bridge ASIC 220 can generally serve as a controller for external peripheral devices $\mathbf{240}_1, \ldots, \mathbf{240}_P$ (where "P" is a positive integer). Examples of an external peripheral device $\mathbf{240}_1, \ldots, \mathbf{240}_P$ may include a hard disk, a keyboard, a mouse, a Universal Serial Bus (USB) peripheral such as a scanner, a printer, a keyboard, a mouse, or a removable media, and other legacy devices.

In addition to the system bus 225, interrupt line 245 and system management interrupt line 246 provide other channels for the South Bridge ASIC 220 to communicate with the CPU 205. In various circumstances, the South Bridge ASIC 220 can raise the interrupt line 245 and/or the system management interrupt line 246 to the CPU 205 for processing. It should be noted that the raising of an interrupt line generally means that an interrupt has been raised or generated and sent and that servicing of the raised or generated interrupt is needed.

In one example, the South Bridge ASIC 220 would raise the interrupt line 245 in an effort to determine whether the network device 200 is functioning properly. In this example, the timely servicing of the raised interrupt generally indicates that the network device 200 is functioning properly. After the South Bridge ASIC 220 generates or raises the interrupt line 245, the South Bridge ASIC 220 will set the response time for the raised interrupt to a predetermined time interval. It should be noted that the predetermined time interval could generally be a programmable value that can be set in accordance with specific applications.

After the interrupt line 245 has been raised and the response time has been set, CPU 205 should service the raised interrupt within the predetermined time interval. If the CPU 205 started servicing the raised interrupt within the predetermined time interval, the network device is deemed to be functioning properly. If the CPU 205 failed to start servicing the raised interrupt within the predetermined time interval, the network device 200 may be malfunctioning and may require corrective actions.

In another example, the South Bridge ASIC 220 can raise the system management interrupt line 246 to instruct the CPU 205 to perform the necessary actions to restart or reconfigure the network device 200.

Figure 3:
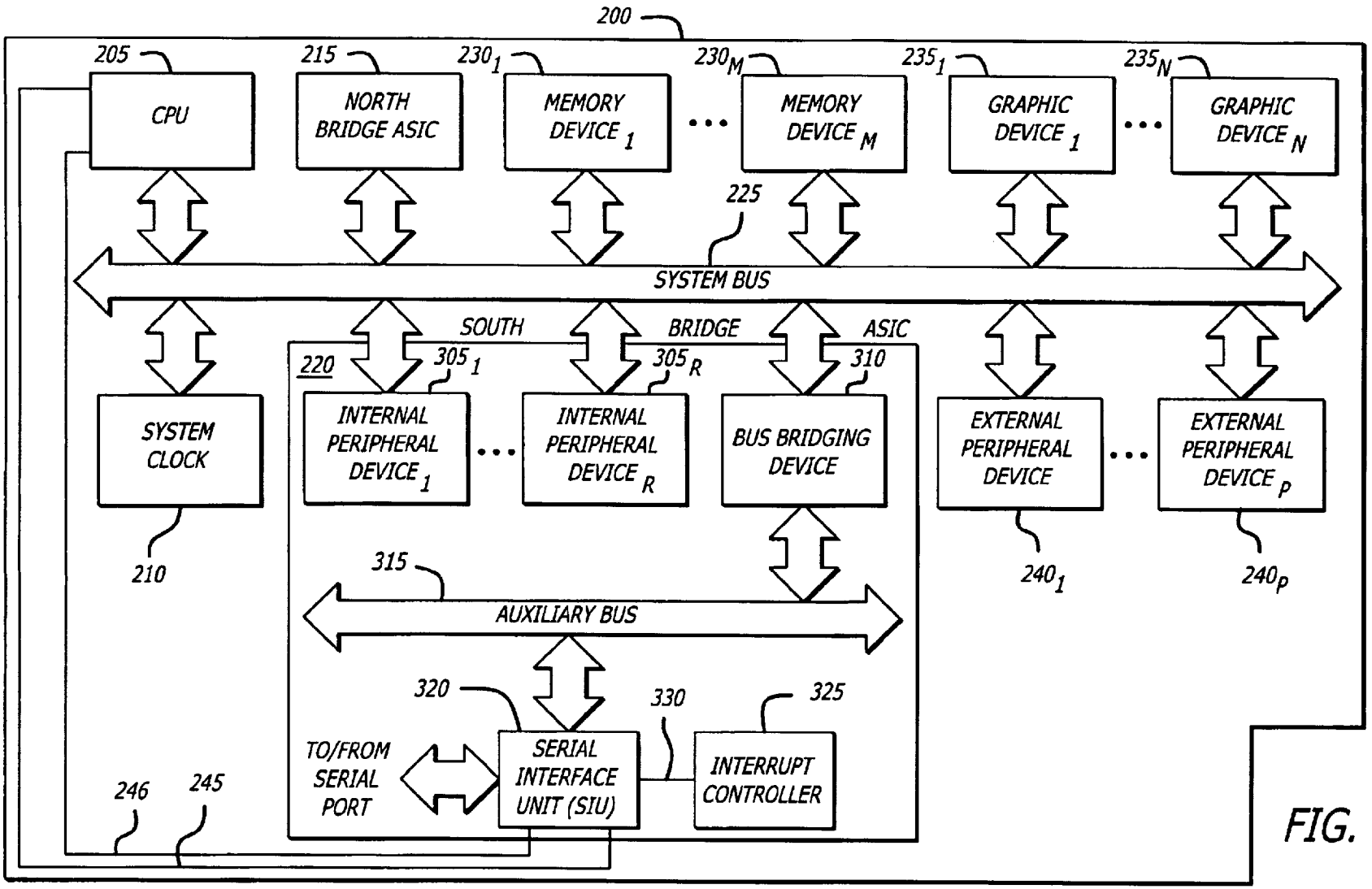
FIG. 3 shows an exemplary block diagram showing pertinent functional components of a network device with additional details on the South Bridge ASIC in accordance with one embodiment of the present invention.

FIG. 3 shows an exemplary block diagram showing pertinent functional components of a network device 200 with additional details on the South Bridge ASIC 220 in accordance with one embodiment of the present invention. South Bridge ASIC 220 can include a plurality of internal peripheral devices $\mathbf{305}_1, \ldots, \mathbf{305}_R$ (where "R" is a positive integer) that are operatively coupled to the system bus. In one embodiment, examples of internal peripheral devices may include a hard disk driver controller, a general purpose timer, a PCI bus controller, a serial communication controller, etc.

South Bridge ASIC 220 can also include a bus-bridging device 310 that is operatively coupled to the system bus 225 and the auxiliary address, data, and control bus (or auxiliary bus) 315 to generally transfer data back and forth between the system bus 225 and the auxiliary bus 315. In one embodiment, the auxiliary bus 315 conforms to the Low Pin Count (LPC) Specification published by Intel® Corporation.

South Bridge ASIC 220 can further include a Serial Interface Unit (SIU) 320. In one embodiment, SIU 320 can include two standard Universal Asynchronous Receivers/Transmitters (UART). SIU 320 is generally a serial communication controller that is operatively coupled to a standard serial port to receive data signals from the serial port and to transmit data signals to the serial port. SIU 320 can also be operatively coupled to the auxiliary bus 315 in order to communicate with other components 205, 210, 215, $\mathbf{230}_1, \ldots, \mathbf{230}_M, \mathbf{235}_1, \ldots, \mathbf{235}_N, \mathbf{240}_1, \ldots, \mathbf{240}_P, \mathbf{305}_1, \ldots, \mathbf{305}_P$, 310 within the network device 200.

SIU 320 can further be operative coupled to the CPU 205 through the interrupt line 245. SIU 320 would raise the interrupt line 245 in an effort to determine whether the network device 200 is functioning properly. As previously discussed, once the interrupt line 245 has been raised, the timely servicing of the interrupt generally indicates that the network device 200 is functioning properly. In other words, after the SIU 320 raises the interrupt line 245, the response time for the interrupt is set to a predetermined time interval. As stated above, the predetermined time interval is generally a programmable value that can be set in accordance to specific applications.

After the interrupt line 245 has been raised and the response time has been set, CPU 205 should the raised interrupt within the predetermined time interval. If the CPU 205 started to service the interrupt within the predetermined time interval, the network device 200 would be deemed as functioning properly. If the CPU 205 failed to start servicing the interrupt within the predetermined time interval, the network device 200 may be malfunctioning and may require corrective actions.

In addition, SIU 320 can be operative coupled to the CPU 205 through the system management interrupt line 245. SIU 320 would raise the system management interrupt line 246 to generally instruct the CPU 205 to perform the necessary actions to restart or reconfigure the device 200.

South Bridge ASIC 320 can additionally include an interrupt controller 325. Interrupt controller 325 generally generates interrupts that are meant to be processed by the SIU 320. Interrupt controller 325 communicates the generated interrupts to the SIU 320 through interrupt line 330. In one embodiment, interrupt controller 325 can be implemented using Intel chipset 8259®.

Figure 4:
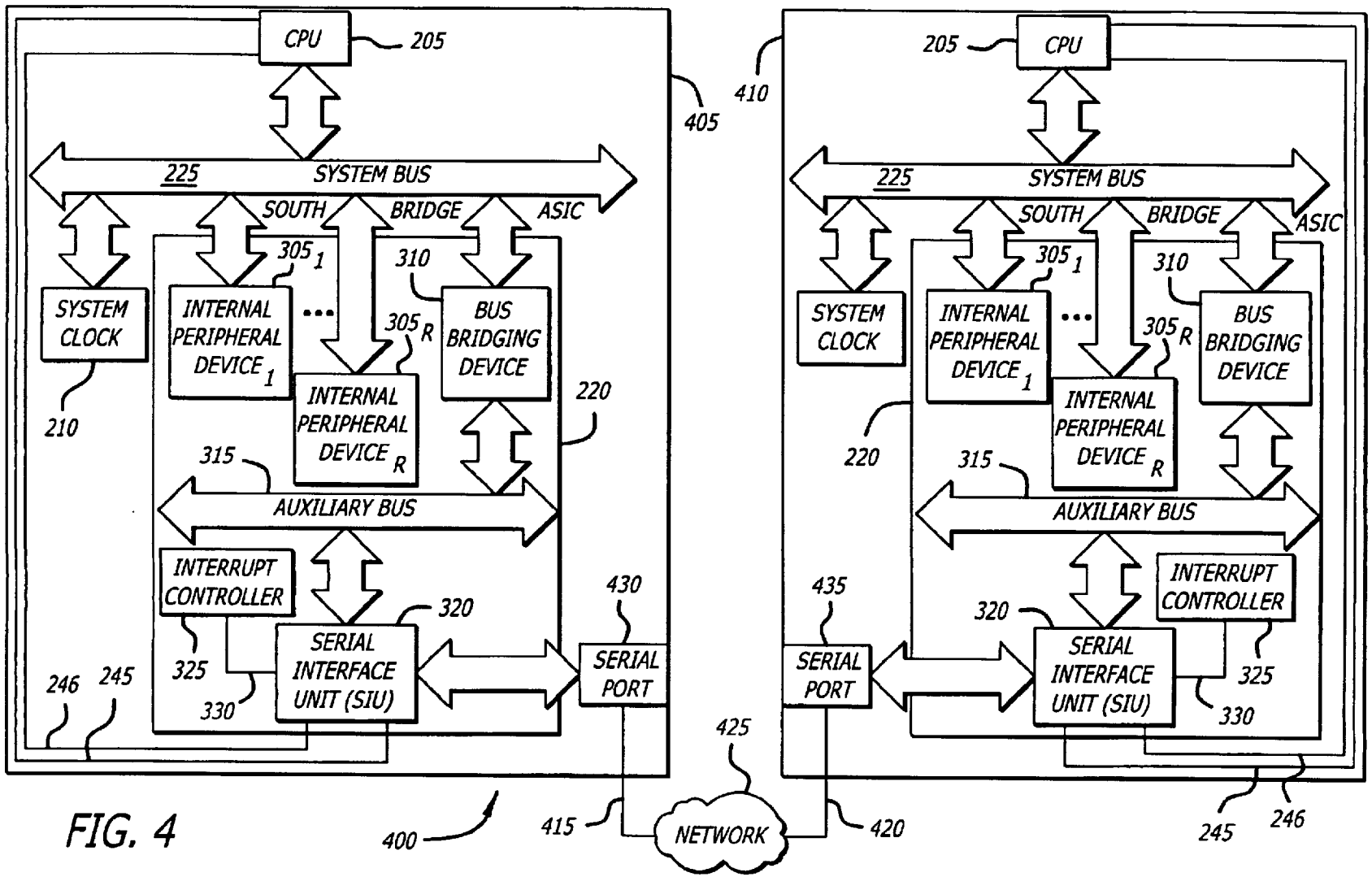
FIG. 4 shows an exemplary simplified version of the networking system 100 shown in FIG. 1 in accordance with one embodiment of the present invention.

FIG. 4 shows an exemplary simplified version of the networking system 100 shown in FIG. 1 in accordance with one embodiment of the present invention. The exemplary simplified networking system 400 of FIG. 4 can include a requesting device 405 and a responding device 410. Each of the requesting device 405 and the responding device 410 can include a standard serial port 430 and 435 respectively. Requesting device 405 and responding device 410 communicate with one another over communication links 415, 420 and network 425 through the respective serial ports 430 and 435 of the devices 405, 410.

As previously stated, a requesting device 405 is generally a network device that initiates and sends a status query to a responding device 410 to request or inquire about the operational status of the responding device 410. A responding device 410 is generally a network device that receives the status query from the requesting device 405 and performs the necessary actions to respond or answer to the status query. Additional information detailing the sequence of events and correspondences between the requesting device 405 and the responding device 410 will be outlined in FIG. 5 and described below in the text accompanying this figure.

It should be noted that the block diagrams of FIG. 4 that represent the requesting device 405 and the responding device 410 are partial block diagrams which generally include pertinent components 205, 210, 220, 225, 245, 246, $\mathbf{305}_1, \ldots, \mathbf{305}_P$, 310, 315, 320, 325, 330 of each of the requesting device 405 and the responding device 410. The components 205, 210, 220, 225, 245, 246, $\mathbf{305}_1, \ldots, \mathbf{305}_P$, 310, 315, 320, 325, 330 of each of the requesting device 405 and the responding device 410 are shown in FIGS. 2 and 3 and described above in the text accompanying those figures.

It should also be noted that the functional components, as shown in FIGS. 2, 3, and 4 and described above in the text accompanying those figures, could be implemented in hardware. However, these functional components can also be implemented using software code segments. Each of the code segments may include one or more programming instructions. If the aforementioned functional components are implemented using software code segments, these code segments can be stored on a machine-readable medium, such as floppy disk, hard drive, CD-ROM, DVD, tape, memory, or any storage device that is accessible by a computing machine.

FIG. 5 generally outlines an exemplary sequence 500 of events and correspondences between the requesting device 405 and the responding device 410 occurring when the requesting device 405 sends or submits a status query to the responding device 410 in accordance with one embodiment of the present invention. Blocks 515 and 520 represent actions that the requesting device performs. Blocks 520, 530, 535, 540, 545, 550, 555, 560, 565, and 570 represent actions that the responding device performs.

In blocks 515 and 520, the requesting device 405 and the responding device 410 are respectively initialized. In block 525, the requesting device 405 then sends a status query to inquire about the operational status of the responding device 410. The requesting device 405 sends or submits the status query over its SIU 320 and its serial port 430, as shown in FIG. 4. After the requesting device 405 sends or submits the status query, the responding device 410 receives the status query sent by the requesting device 405, as shown in block 530. The responding device 410 receives the status query over its serial port 435 and its SIU 320, as shown in FIG. 4. In block 535, responding device 410 raises the interrupt line 245 (shown in FIG. 4) to send an interrupt to its CPU 205 (shown in FIG. 4) upon receiving the status query from the requesting device 405. Responding device 410 also sets the response time to a predetermined time interval (block 535). As previously stated, the predetermined time interval can generally be a programmable value that can be set in accordance to specific applications.

In block 540, it is determined whether the CPU 205 (shown in FIG. 4) of the responding device 410 started servicing the raised interrupt within the predetermined time interval. If the CPU 205 of the responding device 410 started servicing the raised interrupt within the predetermined time interval, the responding device 410 would report a normal status to the requesting device 405, as shown in block 545. The normal status generally means that the responding device is functioning normally and properly. The responding device 410 would use its SIU 320 and serial port 435 (shown in FIG. 4) to report the status to the requesting device 405.

If the CPU 205 (shown in FIG. 4) of the responding device 410 failed to start servicing the raised interrupt, a system management interrupt would be raised or generated and sent to the CPU 205 of the responding device 410, as shown in block 550. As stated above, the system management interrupt generally instructs the CPU 205 of the responding device 410 to perform the necessary actions to restart or reconfigure the device 410. Furthermore, the response time would be set to the predetermined time interval.

In block 555, it is determined whether the CPU 205 (shown in FIG. 4) of the responding device 410 started to service the system management interrupt within the predetermined time interval. If the CPU 205 of the responding device 410 started to service the system management interrupt within the predetermined time interval, the responding device 410 would report a problem status to the requesting device 405, as shown in block 560. The problem status generally indicates that the responding device 410 had malfunctioned after receiving the status query from the requesting device 405 and that the responding device 410 had to restart itself to overcome the malfunction. The responding device 410 would use its SIU 320 and serial port 435 (shown in FIG. 4) to report the problem status to the requesting device 405. After reporting the problem status to the requesting device 405, the responding device 410 would wait for further instructions from the requesting device 405, as shown in block 570. At this time, the requesting device 405 may instruct the responding device 410 to take further corrective actions.

If the CPU 205 (shown in FIG. 4) of the responding device 410 failed to start servicing the system management interrupt within the predetermined time interval, the responding device 410 would send a distress status to the requesting device 405, as shown in block 565. The distress status can include a problem description to generally indicate that the responding device 410 had malfunctioned after receiving the status query from the requesting device 405, that the responding device 410 attempted to restart itself to overcome the malfunction, and that responding device 410 had failed in its attempt to restart itself. The responding device 410 uses its SIU 320 and serial port 435 (show in FIG. 4) to report the status to the requesting device 405. After reporting the distress status to the requesting device 405, the responding device 410 would wait for further instructions from the requesting device 405, as shown in block 570. At this time, the requesting device 405 may instruct the responding device 410 to take further corrective actions.

While certain exemplary embodiments have been described and shown in accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A system comprising:

a requesting device operatively coupled to a network to send a status query through a serial port in the requesting device; and a responding device operatively coupled to the network to receive the status query from the requesting device, the status query inquiring about operational status of the responding device, the responding device receiving the status query through a serial port in the responding device, processing the status query, and reporting the operational status through the serial port in the responding device to the requesting device in response to the status query sent by the requesting device, the responding device includes:

a central processing unit (CPU), and a controller operatively coupled to the CPU and to the serial port in the responding device to receive the status query, the controller raising a first interrupt to the CPU to determine whether the responding device is functioning properly, the controller ascertains that the responding device is functioning properly if the CPU started servicing the first interrupt within a first response time.

2. A system comprising:

a requesting device operatively coupled to a network to send a status query through a serial port in the requesting device; and a responding device operatively coupled to the network to receive the status query from the requesting device, the status query inquiring about operational status of the responding device, the responding device receiving the status query through a serial port in the responding device, processing the status query, and reporting the operational status through the serial port in the responding device to the requesting device in response to the status query sent by the requesting device, the responding device includes:

a central processing unit (CPU), and a controller operatively coupled to the CPU and to the serial port in the responding device to receive the status query, the controller raising a first interrupt to the CPU to determine whether the responding device is functioning properly, the controller raises a second interrupt to the CPU if the CPU failed to start servicing the first interrupt within a first response time, the second interrupt instructing the CPU to restart the responding device.

3. The system of claim 2, wherein the responding device reports a problem status to the requesting device if the CPU of the responding device started servicing the second interrupt within a second response time, the problem status indicating that the responding device had malfunctioned and had to restart itself.

4. The system of claim 2, wherein the responding device reports a distress status to the requesting device if the CPU of the responding device failed to start servicing the second interrupt within a second response time, the distress status indicating that the responding device had malfunctioned, attempted to restart itself and failed in the attempt to restart itself.

5. The system of claim 1, wherein the requesting device receives the operational status of the responding device through the serial port in the requesting device.

6. A device comprising:

a central processing unit (CPU); and a controller operatively coupled to the CPU and to a serial port in the device to receive a status query, the controller raising a first interrupt to the CPU to determine whether the device is functioning properly and ascertaining whether the device is functioning properly if the CPU started servicing the first interrupt within a first response time.

7. The device of claim 6, wherein the controller to raise a second interrupt to the CPU if the CPU failed to start servicing the first interrupt within the first response time, the second interrupt instructing the CPU to restart the device.

8. The device of claim 7, wherein the device reports a problem status to a requesting device if the CPU started servicing the second interrupt within a second response time, the problem status indicating that the device had malfunctioned and had to restart itself.

9. The device of claim 7, wherein the device reports a distress status to a requesting device if the CPU failed to start servicing the second interrupt within a second response time, the distress status indicating that the device bad malfunctioned, attempted to restart itself, and failed in the attempt to restart itself.

* * * * *